United States Patent [19]

Wooding

[11] 4,032,705

[45] June 28, 1977

[54] CONSUMABLE ELECTRODE FURNACE CRUCIBLES

[75] Inventor: Patrick J. Wooding, Moorestown, N.J.

[73] Assignee: Wooding Corporation, Moorestown, N.J.

[22] Filed: Sept. 24, 1975

[21] Appl. No.: 616,365

[52] U.S. Cl. ..... 13/32

[51] Int. Cl.² ..... F27D 1/12

[58] Field of Search ..... 13/9, 9 ES, 11, 32, 13/35

[56] References Cited

FOREIGN PATENTS OR APPLICATIONS 883,016 11/1961 United Kingdom ..... 13/32

*Primary Examiner*—R. N. Envall, Jr.

*Attorney, Agent, or Firm*—Duffield & Lehrer

[57] ABSTRACT

A consumable electrode furnace crucible is disclosed which utilizes a coaxially disposed crucible body, intermediate water guide, and outer crucible jacket disposed upon a base. The bottom portion of the water guide is electrically interconnected to the bottom portion of the crucible body and is otherwise electrically insulated from the crucible jacket and crucible body to provide a coaxial return current path providing substantial magnetic field cancellation. The inner surface of the intermediate water guide is spaced close to the outer surface of the crucible body to define a narrow passage which forces the cooling water to pass across the surface of the crucible body at an ultrahigh velocity to sweep away steam.

9 Claims, 2 Drawing Figures

CONSUMABLE ELECTRODE FURNACE CRUCIBLES

BACKGROUND OF THE INVENTION

The consumable electrode furnace process has been in use for a number of years for the production of purified and defect free ingots. The present invention is applicable to both the vacuum arc and electroslag process. For simplicity of explanation, the electroslag process will be discussed. Essentially the process comprises positioning the consumable electrode within a crucible above a molten slag pool and passing a high current from the electrode through the molten slag into the crucible base. The electrode is progressively melted and reformed as a purified and defect free ingot in the crucible body.

As discussed in U.S. Pat. No. 3,684,001 of which I am a coinventor, any return bus bar configuration which is not coaxial with the current path formed by the electrode, molten pool and ingot, sets up powerful stray fields in the melting zone. The interaction between the vertical components of these fields and the horizontal components of melting current in the molten pool, stirs the metal with such violence as to cause unacceptable segregation at economically high melt rates. A return bus bar which is truly coaxial eliminates this problem by eliminating all vertical components of magnetic field in the melting zone.

One of the first attempts made to reduce the effect of magnetic stirring of the molten metal is the method and apparatus disclosed in U.S. Pat. No. 3,684,001. In this apparatus, the return path for the current was taken from the base of the crucible upwardly through a plurality of legs running vertically from the base of the crucible alongside but external to the outer jacket of the crucible. In this structure, the current flow in the legs was in a direction opposite to the current in the path formed by the electrode, slag, molten metal, ingot and base of the crucible.

The resultant countercurrent flow in the crucible and that in the legs provides opposing magnetic fields which tend to cancel the stirring effect. However, the use of legs requires additional structure and expense in the construction of the furnace. Additionally, the external legs do not present a full coaxial situation, but, instead, some field distortion still exists and magnetic stirring is not completely eliminated.

Another structure which is touched upon lightly in U.S. Pat. No. 3,684,001 and which is in public use is to use the iinnercrucible body itself as the return conductor. In this structure, the upper flange of the crucible body is electrically interconnected to the return current path. Accordingly, the current flow pattern in this structure is downwardly through the electrode into the molten slag, metal and ingot, into the base and thence upwardly through the crucible wall to the return flange.

Using the crucible body as the return current path also has certain drawbacks. One of those drawbacks is that arcing can occur between the solid ingot and the inner wall of the crucible which tends to destroy the crucible itself.

Another requirement in a crucible for the consumable electrode melting process is removed of substantial quantities of heat through the relatively small area of crucible wall which is in contact with the molten slag and metal pool at any given time during the process. For example, a 5 ton electroslag ingot of 20 inches diameter using 15,000 amperes of melting current at 30 volts drop across the melting zone is transferring almost 450 kw of heat through a 6 inch high zone of water-cooled copper crucible wall. This heat transfer rate may be expressed as:

$$\frac{450 \times .947}{6'' \times 20'' \times \pi} = 1.13 \text{ BTU/in}^2\text{/sec}$$

$$\text{kw} \times .947 = \text{BTU's/sec.}$$

To support this high rate of heat flow, the outer wall of the copper crucible tends to rise to a temperature above the boiling point of water, thereby creating steam at the copper-water interface. Since steam is an excellent thermal insulator, effective cooling ceases, the copper temperature rises into the 600° to 900° F range and the crucible body becomes dead soft annealed so that minor mechanical abuse during stripping, handling or cleaning leads eventually to major repairs or scrapping of the crucible.

Experimentation has shown that the best way to remove the steam film as rapidly as it forms is by applying ultrahigh velocity cooling water to the outer surface of the copper crucible wall. A cooling water velocity of at least 10 feet per second has proved to be required, and this velocity must be at the surface of the copper, not merely at the center of a substantial cooling passage of which the crucible copper is one of the walls.

At the preferred cooling water velocity of 20 feet per second, assuming a quarter inch wide cooling water annulus, the volumetric flow is:

$$\frac{22'' \cdot \pi \cdot .25'' \cdot 20 \text{ ft/sec} \cdot 12 \text{ in/ft} \cdot 60 \text{ sec/min}}{231 \text{ in}^3\text{/gal.}} = 1077 \text{ gal. water/min.}$$

Such velocities require high flow rates through small passages, thereby generating pressure drops of the order of 20 to 60 psi, depending on surfaces, shape and length of crucible.

I have conceived that by wrapping a thin copper sheet around the crucible body, spaced away from the crucible by insulators parallel to the direction of flow, a combination ultrahigh velocity cooling water guide and truly coaxial return conductor may be formed.

Since all magnetic field is internal to the coaxial conductor, the outer crucible water jacket structurally strong enough to support the weight of the ingot and the copper crucible, may be fabricated inexpensively from carbon steel.

OBJECTS AMD SUMMARY OF INVENTION

It is an object of the present invention to provide a furnace crucible of a construction which employs a uniform coaxial return current path to eliminate magnetic stirring of the molten pool while avoiding the hazards of returning the current through the crucible body itself.

It is a further object of the present invention to provide a furnace crucible of a construction which creates an ultrahigh water coolant velocity across the outer surface of the crucible body to sweep away steam generated thereon.

The foregoing objects are carried out in the present invention by the utilization of a crucible structure which includes concentrically and/or coaxially disposed crucible body, intermediate water guide and an outer crucible jacket all positioned upon an interconnecting base member. The crucible body is electrically insulated from the return current path except for an interconnection at the bottom of the crucible body with the bottom portion of the water guide. The upper portion of the water guide is electrically interconnected to the return current path. The outer crucible jacket is electrically insulated from the water guide and crucible body.

An inlet water connection is provided at the top of the passageway formed between the concentric outer crucible jacket and water guide. An outlet water connection is provided at the top of the passageway between the water guide and the crucible body. Transfer ports are provided in the lower portion of the water guide for flow communication between the two annular spaces. Water flow through the crucible is thus a countercurrent water flow slowly downwardly between the manifold formed by the passage between the crucible jacket and water guide and rapidly upwardly from the bottom of the water guide through the passage between the water guide and the crucible body, thus also providing cooling on both sides of the current carrying water guide.

The current path during operation of the furnace is downwardly through the electrode, arc or molten slag, as the case may be, molten metal and ingot across the bottom of the crucible body and upwardly in countercurrent truly coaxial relationship through the water guide back to the power supply.

The water guide is spaced very close to the crucible body and secured in place by insulators parallel to the direction of flow. The narrow passage so formed creates an ultrahigh velocity of coolant flow across the surface of the crucible body to remove steam generated thereon.

Other objects and advantages of the present invention will become apparent to those skilled in the art from the detailed description thereof which follows taken in conjunction with the drawings.

DETAILED DESCRIPTION OF INVENTION

Figure 1:
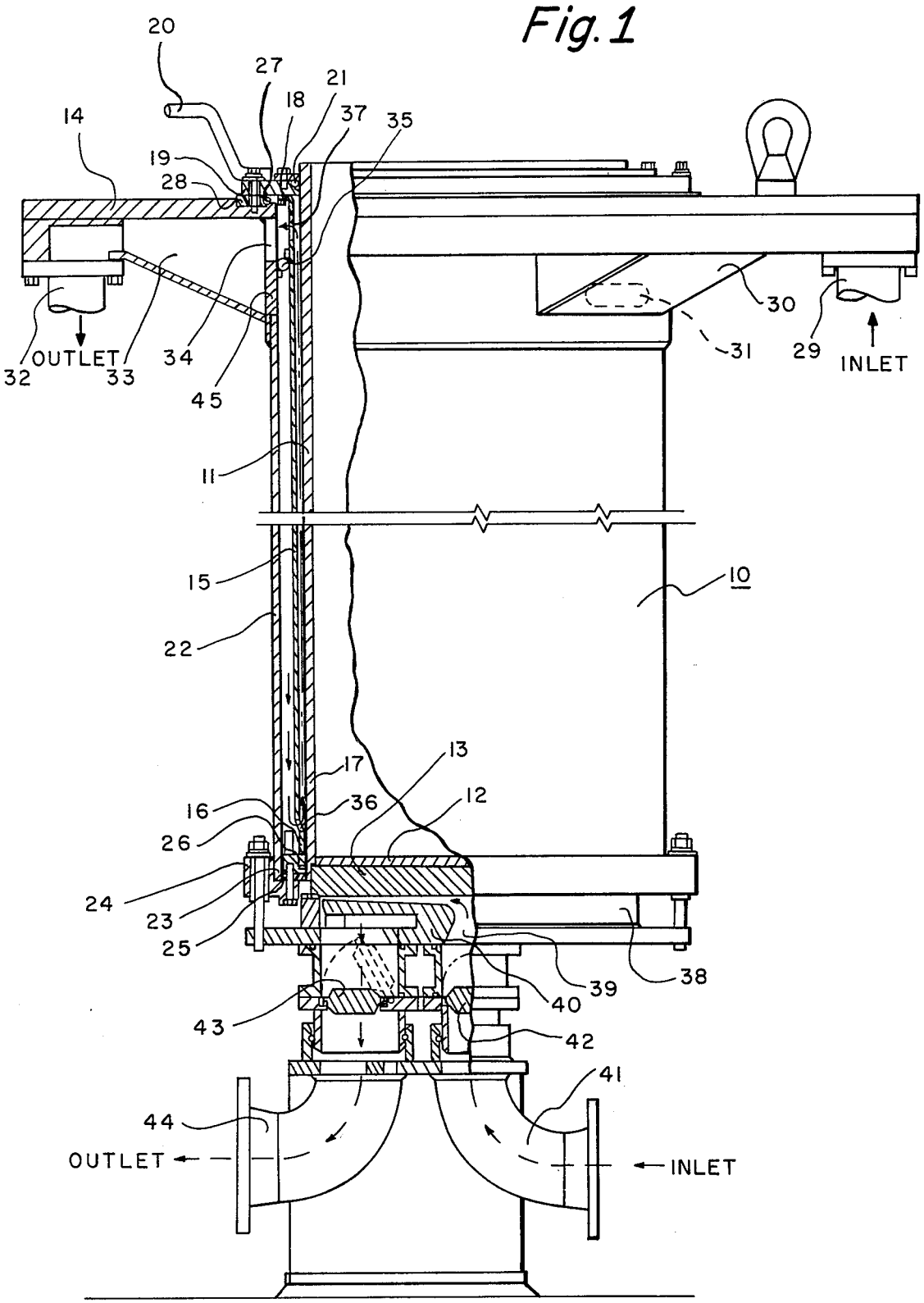
FIG. 1 is a side view, partially in section, of the crucible of the present invention.
Figure 2:
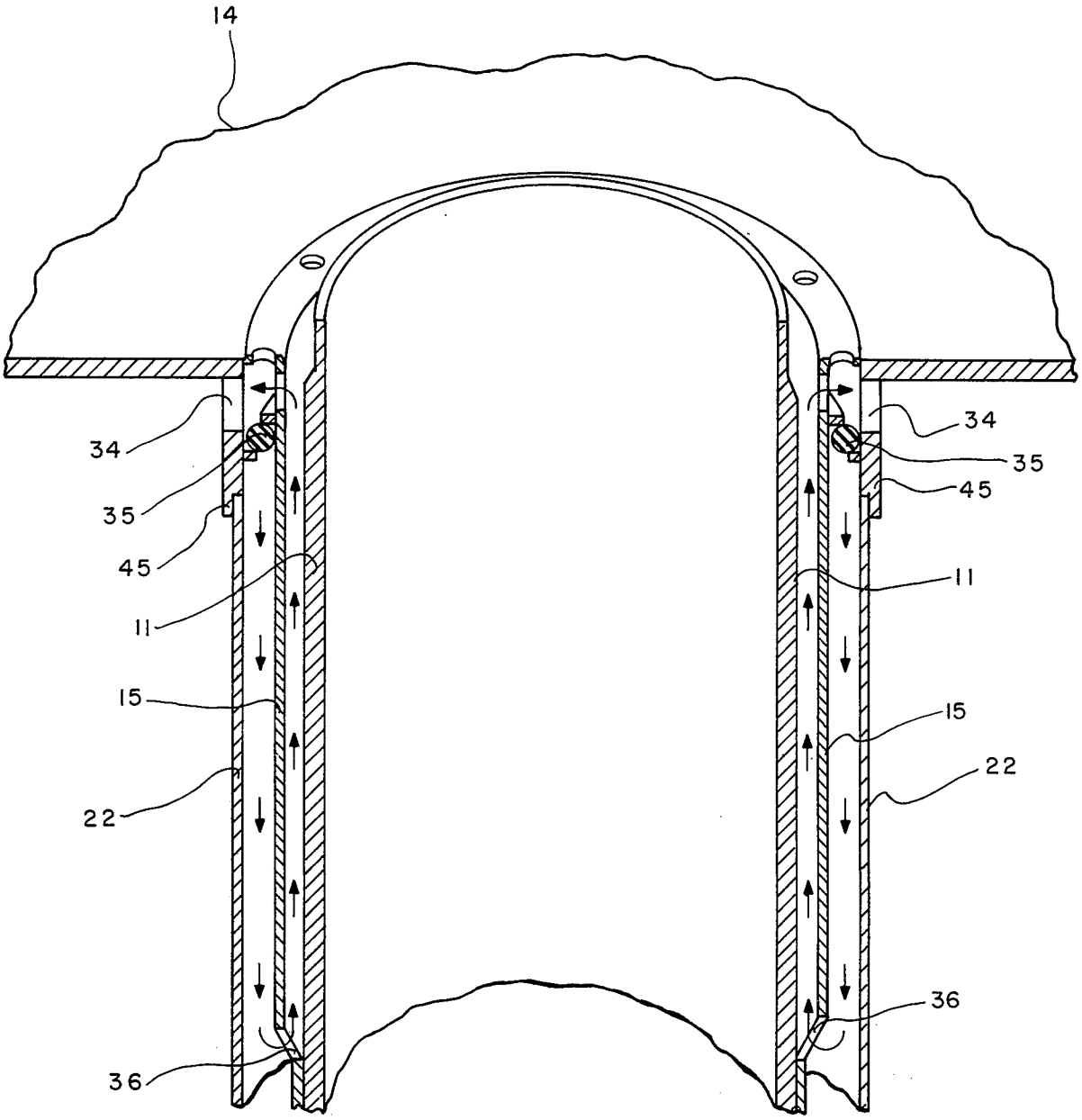
FIG. 2 is a perspective view, in section, of a portion of the crucible of FIG. 1.

A preferred embodiment of the crucible of the present invention is shown in detail in FIGS. 1 and 2 of the drawings wherein like numerals represent and designate like elements.

The overall crucible 10 is formed of a crucible body 11 which is of a cylindrical configuration and preferably formed of a copper material. The lower portion of the crucible body 11 is interconnected to and terminates in a base member formed of a first plate 12 of carbon steel and backed with a larger plate 13 of copper. The upper end of the crucible body 11 extends slightly above an upper crucible flange 14.

The crucible assembly 10 further includes an intermediate copper water guide 15 which is positioned around and concentric with the crucible body 11 and extends from the bottom of the crucible body to substantially the top thereof.

The lower portion 16 of the water guide 15 is electrically interconnected to the lower portion 17 of the crucible body by such means as clamping, brazing or any other appropriate method. The remainder of the inner walls of the water guide 15 are spaced from the outer walls of the crucible body 11 a distance of approximately one quarter of an inch throughout the entire length of both the crucible body and water guide and held in place by electrical insulators (not shown) parallel to the direction of water flow.

The extreme upper end of the water guide 15 includes an outturned circular flange 18. The flange 18 is appropriately electrically interconnected by devices, such as bolts, to a circular conducting block 19 which, in turn, is electrically interconnected to a bus bar 20. An O-ring 21 formed of an electrically insulating material is disposed within a groove in the connecting block 19 and against the outer surface of the upper portion of the crucible body 11, to maintain the crucible body electrically insulated from the bus bar 20 and to separate the supply and return water paths.

The crucible assembly 10 also includes an outer cylindrical concentric steel crucible jacket 22. The lower edge of the crucible jacket 22 fits into an annular groove 23 of a base ring 24 which completely surrounds the base of the crucible. An insulating ring 25 positioned under a compression block 26 maintains the lower edge of the crucible jacket in place and electrically insulated from the crucible body 11.

The upper portion of the crucible jacket 22 terminates in a recess in a downturned portion 45 of the upper crucible flange 14. Both the upper crucible flange 14 and the outer crucible jacket are formed of carbon steel material and are welded together at the point of their juncture.

An O-ring 27 and an electrically insulating ring 28 are fitted into a recess within the inner upper surface of the upper crucible flange 14. The O-ring 27 and insulating ring 28 both hydraulically seal and electrically insulate the upper crucible flange 14 and its associated outer crucible jacket 22 from the bus bar 20.

In a preferred embodiment, the crucible of the present invention includes two inlet conduits 29 preferably spaced 180 degrees apart. The inlet conduits lead to inlet ducts 30 which discharge into inlet ports 31 positioned in the outer surface of the crucible jacket 22, as best shown in phantom in FIG. 1.

In a similar manner, two outlet conduits 32 are provided which are spaced 180° from one another. The outlet conduits are, in a preferred embodiment, spaced at 90° intervals from the two inlet ports 31. The outlet conduits 32 are in communication with an outlet duct 33 which, in turn, communicates with an outlet port 34 positioned in the upper wall of the crucible jacket 22.

An O-ring is positioned between the inner surface of the crucible jacket 22 and outer surface of the water guide 15 intermediate the elevation of the inlet ports 31 and outlet ports 34. Additionally, the lower portion of the water guide 15 includes a plurality of transfer ports 36. In a like manner, a plurality of further transfer ports 37 are positioned in the upper portion of the water guide above the O-ring 35. In this manner, water which is forced through conduits 29 will flow through ducts 30 and inlet ports 31 downwardly through the manifold formed between the crucible jacket and the outer surface of the water guide 15, through the lower transfer ports 36 and return between the inner surface of the water guide 15 and outer surface of the crucible body 11 towards the upper transfer ports 37. The water discharging from the upper transfer ports 37 will flow through the discharge ports 31, discharge ducts 33 and discharge conduit 32 back to the cooling tower.

The cooling water applied to the inlet conduits 29 need not exceed standard industrial water pressures of 40 to 80 psi. Very little pressure drop is experienced in the coolant flow in the manifold between the outer jacket and crucible body to the point of the transfer ports 36. However, the flow restriction created by the narrow annulus formed by the water guide and crucible body accelerates the water flow to an ultrahigh velocity of 20 feet per second or greater. This ultrahigh velocity flow sweeps away steam which has formed on the crucible body and greatly increases the overall heat transfer rate.

The base or stool of the crucible is likewise water cooled. An annular ring 38 positioned below and upon the outer circumference of the base plate 13 provides a cooling chamber 39. A distribution ring 40 is positioned within the cooling chamber and includes a central opening therein which is in communication with an inlet pipe 41 through which cooling water is forced past a check valve 42 into the cooling chamber. The cooling water is passed between the distribution ring 40 and the under surface of the lower base plate 13 whereupon it is discharged back past a check valve 43 through a discharge conduit 44 to the cooling tower.

From the foregoing description of the present invention it is to be appreciated that the concentric closely spaced water guide and crucible arrangement provides absolutely perfect coaxial return current conduction through the crucible assembly, keeping the effects of magnetic stirring of the molten metal to a minimum. Additionally, the water guide maintains water flowing on either side of the water guide which maintains the return conductive path as cool as possible while creating an ultrahigh water velocity flow on the outer surface of the crucible body. Additionally, the crucible body is partially isolated from the return current path and arcing and consequent burning of the crucible body are avoided.

The present invention may be embodied in other specific forms without departing from the spirit or essential attributes of the invention. It is to be understood that the invention is equally applicable to vacuum arc furnaces. Accordingly, reference should be made to the appended claims, rather than to the specification as indicative of the scope of the invention.

I claim:

1. A crucible used in a consumable electrode furnace comprising:
   - an electrically conductive crucible body;
   - a crucible jacket disposed coaxially with the crucible body;
   - an electrically conductive water guide disposed coaxially with and between the jacket and the crucible body; and
   - means electrically interconnecting the lower portion of the crucible body to the lower portion of the water guide and electrically insulating the remainder of the water guide from the crucible body, whereby the water guide provides a return coaxial conductive path during operation of the furnace.

2. A crucible used in a consumable electrode furnace comprising:
   - an electrically conductive crucible body;
   - an outer crucible jacket disposed about the crucible body;
   - a base member interconnecting the lower portions of both the crucible body and crucible jacket;
   - a thin electrically conductive water guide disposed between the crucible jacket and crucible body; and
   - means electrically interconnecting the lower portion of the crucible body to the lower portion of the water guide and electrically insulating the remainder of the water guide from the crucible jacket and crucible body, whereby the water guide provides a return coaxial conductive path during operation of the furnace.

3. In a consumable electrode furnace including a crucible body and an outer crucible jacket, a crucible base, power interconnection means from a power supply through the consumable electrode, arc or molten slag, molten metal pool and ingot, with a return conductive path providing canceling magnetic fields, the improvements comprising:
   - means electrically insulating the top of the crucible body from the return conductive path;
   - a water guide positioned between the crucible body and the crucible jacket;
   - means electrically interconnecting the bottom of the water guide to the bottom portion of the crucible body; and
   - means electrically interconnecting the top of the water guide to the return conductive path whereby the water guide becomes a double sided water cooled fully coaxial return conductive path providing magnetic field canceling effects.

4. The consumable electrode furnace of claim 3 wherein the outer crucible jacket is electrically insulated from the water guide.

5. A crucible used in a consumable electrode furnace comprising:
   - a crucible body;
   - a coolant guide disposed coaxially with the crucible body and closely spaced therefrom defining a highly restrictive narrow flow passage; and
   - liquid coolant supply means in communication with the passage for supplying coolant thereto whereby the velocity of the coolant will be accelerated to an ultrahigh velocity across the surface of the crucible body in its passage of the passage.

6. In a consumable electrode furnace including a coaxially disposed crucible body, an outer crucible jacket and a crucible base, the improvements providing improved cooling of the crucible body comprising:
   - an intermediate coolant guide disposed between the crucible jacket and crucible body and in close proximity to the crucible body to define a narrow, restrictive flow passage therebetween and a larger nonrestrictive flow passage between the crucible jacket and the guide;
   - liquid coolant inlet means to the flow passage between the crucible jacket and guide;
   - transfer ports permitting flow communication through the guide; and
   - liquid coolant outlet means in communication with the flow passage between the guide and crucible body whereby liquid coolant flow through the crucible will be accelerated to an ultrahigh velocity across the surface of the crucible body as its passage thereof to sweep steam therefrom.

7. The furnace of claim 6 wherein the transfer ports are positioned in the lower portion of the guide and the liquid coolant outlet means is positioned in the upper portion of the flow passage between the guide and crucible body to create an upwardly directed coolant flow.

8. The furnace of claim 7 wherein the liquid coolant inlet means are disposed in the upper portion of the flow passage between the crucible jacket and guide to create a countercurrent flow across the surfaces of the guide.

9. In a consumable electrode furnace including a crucible body and liquid coolant means flowing in contact with the outer surface of the crucible body, the improvements in the method of cooling of the crucible body comprising:

directing the liquid coolant across the surface of the crucible body to be cooled at an ultrahigh velocity of at least 10 feet per second to sweep away steam generated upon the surface thereof.

* * * * *